United States Patent [19]

Horigome et al.

[11] 4,147,956

[45] Apr. 3, 1979

[54] WIDE-BAND COUPLED-CAVITY TYPE TRAVELING-WAVE TUBE

[75] Inventors: Toshinori Horigome; Takao Kageyama, both of Tokyo, Japan

[73] Assignee: Nippon Electric Co., Ltd., Tokyo, Japan

[21] Appl. No.: 774,403

[22] Filed: Mar. 4, 1977

[30] Foreign Application Priority Data

| | | | |
|---|---|---|---|
| Mar. 16, 1976 | [JP] | Japan | 51-28343 |
| Mar. 16, 1976 | [JP] | Japan | 51-28344 |
| Dec. 23, 1976 | [JP] | Japan | 51-155734 |

[51] Int. Cl.[2] ..... H01J 25/34

[52] U.S. Cl. ..... 315/3.6; 315/39.3; 315/3.5

[58] Field of Search ..... 315/3.5, 3.6, 39.3

[56] References Cited

U.S. PATENT DOCUMENTS

| | | | |
|---|---|---|---|
| Re. 25,329 | 2/1963 | Bates | 315/3.6 X |
| 2,760,161 | 8/1956 | Cutler | 315/3.6 X |
| 2,956,200 | 10/1960 | Bates | 315/3.5 |
| 3,123,736 | 3/1964 | Christoffer et al. | 315/3.6 |
| 3,538,377 | 11/1970 | Slocum | 315/3.6 |
| 3,576,460 | 4/1971 | Harman | 315/3.6 |
| 3,602,766 | 8/1971 | Grant | 315/3.6 |
| 3,716,745 | 2/1973 | Phillips | 315/3.6 |
| 3,924,152 | 12/1975 | Butwell et al. | 315/3.6 |

*Primary Examiner*—Saxfield Chatmon, Jr.
*Attorney, Agent, or Firm*—Ostrolenk, Faber, Gerb & Soffen

[57] ABSTRACT

A traveling wave tube employing a coupled-cavity type slow-wave circuit and having high gain and efficiency over a wide operating frequency band as a result of a design in which the slow-wave circuits are separated into first and second (i.e. fore) and output slow-wave circuits connected to one another by sever sections containing nonreflectivity terminated waveguides. The synchronizing frequency of one of the fore slow-wave circuits is selected to be different from that of the other fore slow-wave circuit and the output slow-wave circuit. The aforesaid slow-wave circuits incorporate coupler cavities at the opposite ends thereof and a plurality of main unit cavities positioned between the coupler cavities. The desired synchronizing frequencies are obtained by controlling the dimensions of the cavities, interaction gaps, apertures and coupling irises.

9 Claims, 16 Drawing Figures

FIG. 1a.
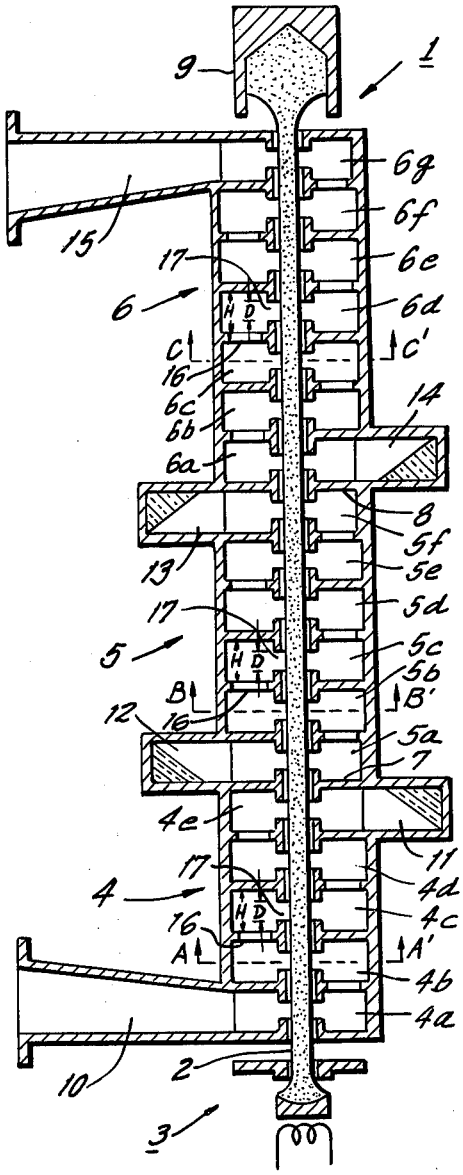
FIG. 1d.
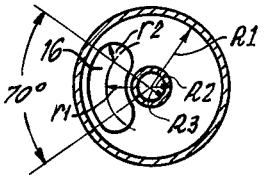
FIG. 1c.
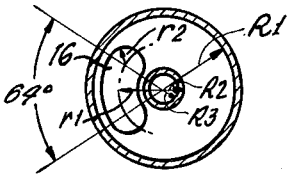
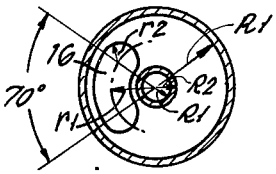
FIG. 1b.

FIG. 7a.
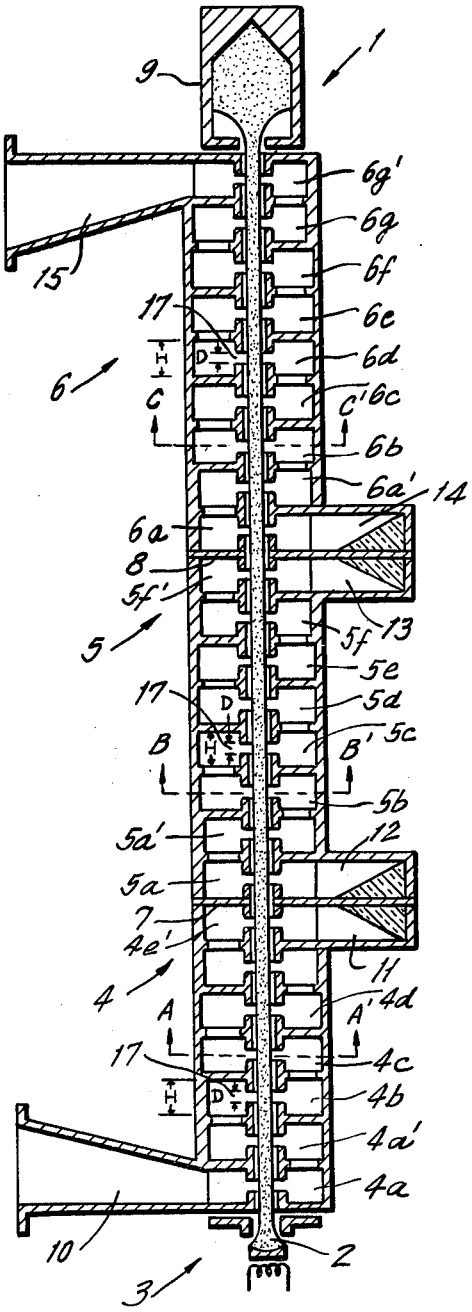
FIG. 7d.
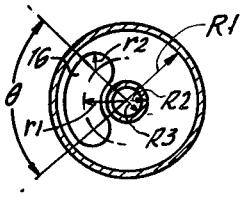
FIG. 7c.
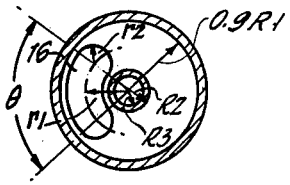
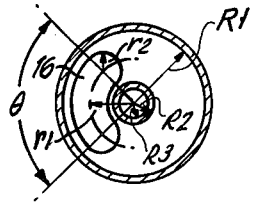
FIG. 7b.

WIDE-BAND COUPLED-CAVITY TYPE TRAVELING-WAVE TUBE

BACKGROUND OF THE INVENTION

The present invention relates to a traveling-wave tube, and more particularly, to a traveling-wave tube employing a coupled-cavity type slow-wave circuit.

A coupled-cavity type traveling-wave tube is characterized by a higher withstand power than a helix type traveling-wave tube, and it is widely used as high power sources in microwave and millimeter-wave bands such as output power tubes in ground stations for satellite communication. In cases where it is used for communication lines of large capacity and high quality as is the case with satellite communications, mostly it is used in a region having a good linearity, that is, in a small signal operation range where the output power level of the tube is low, so that small signal gain versus frequency characteristics serve as important factors for determining whether the tube is good or bad. However, the coupled-cavity type traveling-wave tube has a disadvantage that the operating band width of its small signal gain versus frequency characteristics is extremely narrow as compared with that of a traveling-wave tube employing a helical structure slow-wave circuit. Therefore, as means for extending this band width the following techniques have been proposed. That is, according to a disclosure in Japanese Patent Publication No. 42-3973 it has been proposed that a protrusion for concentrating a magnetic field is formed in the proximity of a coupling iris between adjacent cavities to increase the pass-band width of a slow-wave circuit and thereby the operating band width of a tube can be broadened. However, if the pass-band width of a slow-wave circuit is increased in this way, then a coupling impedance of this slow-wave circuit is reduced, so that there was a disadvantage that a gain and an efficiency of a tube were lowered. In addition, according to a disclosure in Japanese Patent Publication No. 44-16090, a method is known in which approximately at the center of a slow-wave circuit is provided a distributed attenuator region as spaced from a sever section at a predetermined interval, and thereby oscillation at a band edge is prevented and also an operating band width of a tube is broadened. However, this method has a disadvantage that because of increase of attenuation in the output slow-wave circuit, the gain is largely lowered.

Heretofore, when a a coupled-cavity structure slow-wave circuit is employed in a travelling-wave tube, it has been the common practice to sever the slow-wave circuit into two sections consisting of one preliminary or fore slow-wave circuit (input slow-wave circuit) and an output slow-wave circuit for the purpose of suppressing oscillation caused by a reflected wave from its output end as shown in FIG. 2 on page 1832 of an article by R. J. Collier, G. D. Helm, J. P. Laico and K. M. String entitled "The Ground Station High-Power Traveling-Wave Tube" (The Bell System Technical Journal, July 1963), or to sever the slow-wave circuit into three sections consisting of two preliminary slow-wave circuits (an input slow-wave circuit and an intermediate slow-wave circuit) and an output slow-wave circuit for the same purpose in the case where the traveling-wave tube has a higher gain as shown in Japanese Patent Publication No. 44-16090. In these prior art tubes, each of the severed slow-wave circuits consists of coupler cavities positioned at its opposite ends and a number of main cavities intervening between these coupler cavities, and the coupling cavity is normally formed smaller in diameter or in height than the main cavity in order to provide characteristic impedance matching with a waveguide to be connected to this coupler cavity. Cavity diameters, heights and sizes of coupling irises between adjacent cavities of the respective main cavities, interaction gap dimensions of the respective cavities, and distances between centers of interaction gaps in the adjacent cavities, are equal throughout the respective slow-wave circuits, and therefore, $TM_{01}$ cavity mode pass-band widths and phase velocities of traveling waves are equal in the respective slow-wave circuits. The phase velocity is a function of the frequency, and in the prior art, a frequency for giving a phase velocity equal to a D.C. beam velocity, that is, a synchronizing frequency is often selected at an intermediate point between a lower end frequency of a desired operating band and a $TM_{01}$ cavity mode lower cut-off frequency of a slow-wave circuit in view of an efficiency of a tube. As a result of these provisions, maximum gain is obtained at the synchronizing frequency outside of the operating band, and within the operating band the gain is lowred as the frequency is raised although there exist some gain ripples caused by internal reflection waves in the slow-wave circuit, so that even if a $TM_{01}$ cavity mode pass-band width of a slow-wave circuit should be extended by the above described method, the operating band width would be limited to 30~40% of the $TM_{01}$ cavity mode pass-band width.

BRIEF DESCRIPTION OF THE INVENTION

It is one object of the present invention to provide a coupled-cavity type traveling-wave tube having a high withstand power which is given a broad operating band width without lowering the gain and the efficiency.

According to one feature of the present invention, there is provided a wide-band coupled-cavity type traveling-wave tube that is severed along an electron beam path into one or more preliminary slow-wave circuits and one output slow-wave circuit, the respective slow-wave circuits being connected via a circuit sever section containing a non-reflectively terminated waveguide, each said slow-wave circuit consisting of coupler cavities at its opposite ends and a plurality of main cavities, characterized in that in at least one preliminary slow-wave circuit, a synchronizing frequency, at which a phase velocity of a high frequency signal propagated in an electron beam as density modulated thereby is equalized to a phase velocity of a traveling wave propagated at a slowed velocity through the slow-wave circuit, is made different from a synchronizing frequency of the other preliminary slow-wave circuit or circuits and the output slow-wave circuit.

In view of the fact that the upper cut-off frequency, the lower cut-off frequency and the coupling impedance of a coupled-cavity type slow-wave circuit are determined by the dimensions of main cavities in the slow-wave circuit, according to the present invention, the gain and the efficiency are enhanced by raising the coupling impedance of at least one preliminary slow-wave circuit by appropriately selecting the dimensions of the main cavities, while the band width is broadend by selecting the synchronizing frequency of the preliminary slow-wave circuit so as to be different from the synchronizing frequency of an output slow-wave circuit, and thereby it is intended to obtain a coupled-cavity type traveling-wave tube having a high gain, a high efficiency and a broad operating pass-band width.

According to the present invention, a broad operating band that exceeds 50 percent of the $TM_{01}$ cavity mode pass-band width of the output slow-wave circuit can be realized without lowering the gain and the efficiency of the tube.

BRIEF DESCRIPTION OF THE FIGURES

Now the present invention will be described in more detail in connection to its preferred embodiments illustrated in the accompanying drawings, in which:

FIG. 1(*a*) is a longitudinal cross-section view showing the general construction of an essential part of a 3-section coupled-cavity type traveling wave tube according to a first preferred embodiment of the present invention, FIG. 1(*b*) is a transverse cross-section view of the same traveling-wave tube taken along line A—A′ in FIG. 1(*a*), FIG. 1(*c*) is another transverse cross-section view of the same traveling-wave tube taken along line B—B′ in FIG. 1(*a*), FIG. 1(*d*) is still another transverse cross-section view of the same traveling-wave tube taken along line C—C′ in FIG. 1(*a*)

DETAILED DESCRIPTION OF THE INVENTION

Figure 2:
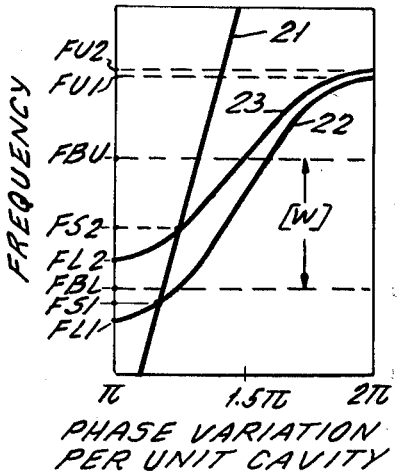
FIG. 2 is a graphical representation of the synchronizing relationship between traveling-waves on the respective slow-wave circuits and the electron beam in the tube shown in FIG. 1(*a*) and an operating band width [w] of the tube.

Referring now to FIG. 1(*a*) of the drawings, a first preferred embodiment of the severed coupled-cavity type traveling-wave tube according to the present invention is shown in longitudinal cross-section. In this figure, a severed coupled-cavity type traveling-wave tube 1 is composed of an electron gun assembly 3 for forming and ejecting an electron beam 2, two preliminary slow-wave circuits along a long beam path, that is, an input slow-wave circuit 4 and an intermediate slow-wave circuit 5, a first circuit sever section 7 and a second circuit sever section 8 for decoupling circuit waves between these respective slow-wave circuits, and a collector electrode 9 disposed at a terminal end of the electron beam.

The input slow-wave circuit 4 consists of a pair of coupler cavities 4*a* and 4*e* at the opposite ends of the slow-wave circuit and three main cavities 4*b*, 4*c* and 4*d* disposed therebetween. The five unit cavities 4*a*, 4*b*, 4*c*, 4*d* and 4*e* are electromagnetically coupled through coupling irises 16 provided in the partition walls between the cavities. An input waveguide 10 is coupled to one end of the slow wave circuit 4, a non-reflectively terminated waveguide 11 is coupled to the remaining end of the wave circuit 4.

The intermediate slow-wave circuit 5 is constructed with a total of six unit cavities coupled to each other and consists of a pair of coupler cavities 5*a* and 5*f* and four main cavities 5*b*, 5*c*, 5*d* and 5*e*. Opposite ends of the slow-wave circuit 5 are connected to non-reflectively terminated waveguides 12 and 13, respectively. The output slow-wave circuit 6 is constructed of a total of seven unit cavities coupled to each other and which consists of a pair of coupler cavities 6*a* and 6*g* and five main cavities 6*b*, 6*c*, 6*d*, 6*e* and 6*f*. One end of the slow-wave circuit is connected a non-reflectively terminated waveguide 14 and the other end is connected to an output waveguide 15.

The height H (FIG. 1*a*) and the inner radius $R_1$ (FIG. 1*b*) of each main cavity, the outer radius $R_2$ and the inner radius $R_3$ of the drift tube, and the interaction gap distance D are respectively selected to be equal in each slow-wave circuit 4, 5 and 6 and throughout the respective slow-wave circuits. Additionally, in order to provide characteristic impedance matching between the waveguide and the slow-wave circuit, only the diameters of the coupler cavities are selected to be smaller than those of the main cavities. However, with regard to the dimensions of the coupling irises 16 between the adjacent main cavities, although a radius $r_1$ of an aperture center line from the center of the main cavity and a width $2r_2$ of an aperture are respectively selected to be equal throughout the respective cavities, as shown in FIGS. 1(*b*) 1(*c*) and 1(*d*), an aperture center angle is equally selected at 70 degrees in the input slow-wave circuit 4 (FIG. 1*b*) and in the output slow-wave circuit 6 (Fig. 1*c*), whereas in the intermediate slow-wave circuit 5 it is reduced to 64 degrees (FIG. 1*c*).

In operation, a high-frequency input signal fed into the input slow-wave circuit 4 via the input waveguide 10, induces a traveling-wave electric field across interaction gaps 17. This traveling-wave density-modulates the electron beam 2 which moves substantially at the same velocity as, and simultaneously with, the traveling-wave as it travels along the input slow-wave circuit 4. During this time, the the traveling-wave increases its amplitude by absorbing kinetic energy from this electron beam 2 and eventually enters in the non-reflectively terminated waveguide 11. On the other hand, the electron beam 2 that has been density-modulated in the input slow-wave circuit 4 induces a traveling-wave electric field in the intermediate slow-wave circuit 5, so that the electron beam 2 is further strongly density-modulated by interaction with this traveling-wave and eventually enters in the output slow-wave 6, where a traveling-wave electric field having a further increased amplitude is induced. This traveling-wave further absorbs kinetic energy of the electron beam 2, and after its amplitude has been increased, it is derived as a high frequency signal at an external circuit through the output waveguide 15. The gain versus frequency characteristics between this high frequency signal derived at the external circuit and the input high frequency signal, are determined by the synchronizing relations between the traveling-waves on the respective slow-wave circuits and the election beam.

With reference to FIG. 2, the synchronizing relationship between the traveling waves on the respective slow-wave circuits and the electron beam and a desired operating band width [W] of the tube in the preferred embodiment illustrated in FIG. 1 are shown graphically, in which the straight line 21 represents phase versus frequency characteristics of the high frequency signal propagating at the D.C. beam velocity as density modulation of the electron beam 2, the curve 22 represents the phase versus frequency characteristics of the traveling-waves propagating respectively through the input slow-wave circuit 4 and the output slow-wave circuit 6 which have the larger aperture center angle, and the curve 23 represents phase versus frequency characteristic of the traveling-wave propagating through the intermediate slow-wave circuit 5 which has the smaller aperture center angle. From a cross point between the straight line 21 and the curve 22 is determined a synchronizing frequency FS1 of the input slow-wave circuit 4 and the output slow-wave circuit 6, and from a cross point between the straight line 21 and the curve 23 is determined a synchronizing frequency FS2 of the intermediate slow-wave circuit 5. The reason why the synchronizing frequency appears at two points as described above, is because the phase velocity of the traveling-wave propagating through the intermediate slow-wave circuit 5 is faster than that of the traveling waves propagating through the input slow wave circuit 4 and the output slow-wave circuit 6, due to the fact that since the dimensions of the main cavities in the respective slow-wave circuits are all the same except for the aperture center angles of the coupling irises, a $TM_{01}$ cavity mode upper cut-off frequency FU2 of the intermediate slow-wave circuit 5 is only a little higher than a $TM_{01}$ cavity mode upper cut-off frequency FU1 of the input slow-wave circuit 4 and the output slow-wave circuit 6, whereas since the aperture center angle of the coupling irises in the intermediate slow-wave circuit 5 is smaller, a $TM_{01}$ cavity mode lower cut-off frequency FL2 of the intermediate slow-wave circuit 5 is far higher than a $TM_{01}$ cavity mode lower cut-off frequency FL1 of the input slow-wave circuit 4 and the output slow wave circuit 6.

In addition, according to such construction, whereas the $TM_{01}$ cavity mode upper cut-off frequencies are substantially equal to each other, the lower cut-off frequencies can be varied by varying the aperture area of the coupling irises between adjacent main cavities, so that in the intermedite slow-wave circuit in which the aperture area of the coupling irises is reduced, the lower cut-off frequency is raised and the pass-band width also becomes narrow, but the phase velocity of the traveling-wave on the slow-wave circuit increases and the coupling impedance is also raised. Consequently, the synchronizing frequency of the intermediate slow-wave circuit in which the aperture area of the coupling irises is reduced, can be placed within the operating band without lower operating efficiency.

Figure 3:
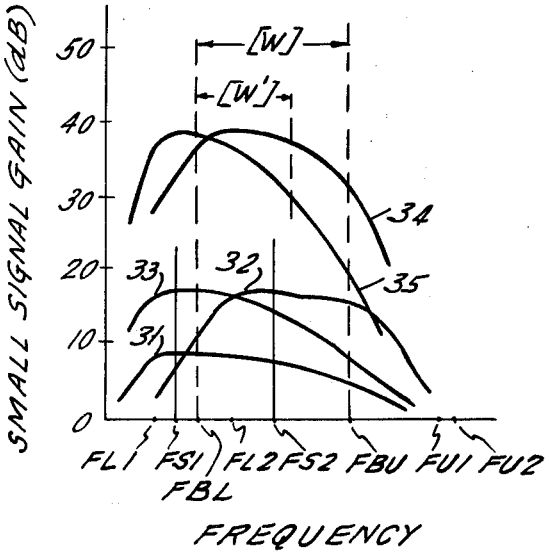
FIG. 3 is a graphical representation of small signal gain (dB) versus frequency characteristic curves of the tube shown in FIG. 1(*a*) and a tube according to the prior art design, and amplification characteristics of the respective slow-wave circuits.

FIG. 3 shows the small signal gain versus frequency characteristics of the coupled-cavity type traveling-wave tube according to the present invention illustrated in FIG. 1(*a*) and a coupled-cavity type traveling-wave tube according to the prior art design as compared with each other. In this figure, a curve 35 represents the characteristics of the tube according to the prior art design, while a curve 34 represents the characteristics of the tube shown in FIG. 1(*a*). According to the prior art design, the synchronizing frequency is the same throughout the respective slow-wave circuits, and is selected at a frequency FS1 that is lower than a desired operating band lower edge frequency FBL, so that maximum gain is obtained at the frequency FS1 (In FIG. 3, the point FBL on the curve 35 is located in the neighborhood of the maximum gain point, but this is due to the fact that the curve 35 represents the characteristics of small signal operation, and for large signal operation the point FBL appears at the lower limit point of the operating band width that is 6 dB lower than the maximum gain point.), but at higher frequencies the gain is lowered at a uniform rate, and thus an operating band width [W'] of the prior art tube was limited to 33% of the pass-band width of the output slow-wave circuit.

According to the preferred embodiment of the present invention illustrated in FIG. 1(*a*), the sole amplification characteristics of the input slow-wave circuit 4 and the output slow-wave circuit 6 are represented by curves 31 and 33, respectively, whose maximum gain points occur at FS1. Since the synchronizing frequency FS2 of the intermediate slow-wave circuit 5 is selected at a frequency lower than an operating band upper edge frequency FBU of the tube according to the prior art design, the amplification characteristics of the intermediate slow-wave circuit 5 are shown by curve 32, which just compensates for the degrades portions in the characteristics shown by the curves 31 and 33, and the coupling impedance of the intermediate slow-wave circuit 5 is increased, so that it can be seen that the operating band width [W] of the tube 1 can be improved up to 53% of the bass-band width of the output slow-wave circuit 6 without lowering the gain.

In the above-described embodiment, since the $TM_{01}$ cavity mode lower cut-off frequency FL2 of the intermediate slow-wave circuit 5 is selected to be higher than the operating band lower edge frequency FBL of the tube, the operation of the intermediate slow-wave circuit 5 at a frequency lower than the frequency FL2 is considered to be such that interactions similar to those in a multi-cavity klystron, in which coupling between the respective cavities is loose as if the tube is composed of low-Q cavities, are effected.

Furthermore, since the pass-band widths of the input slow-wave circuit 4 and the output low-wave circuit 6 contain the operating band width [W] therein, they can be easily matched with external circuits via the input waveguide 10 and the output waveguide 15, respectively. Especially in the output slow-wave circuit 6 which handles a larger electric power, the aperture area of the irises are selected to be large and thereby the pass-band width is always selected to be broad.

While in the above-described first preferred embodiment, in only one of the two fore slow-wave circuits, the aperture area of the irises was selected to be smaller than that in the other slow-wave circuits, the present invention can be practiced in various modified forms by selecting the aperture area of the irises in two or more fore slow-wave circuits to be different from the remaining slow-wave circuits.

Figure 4:
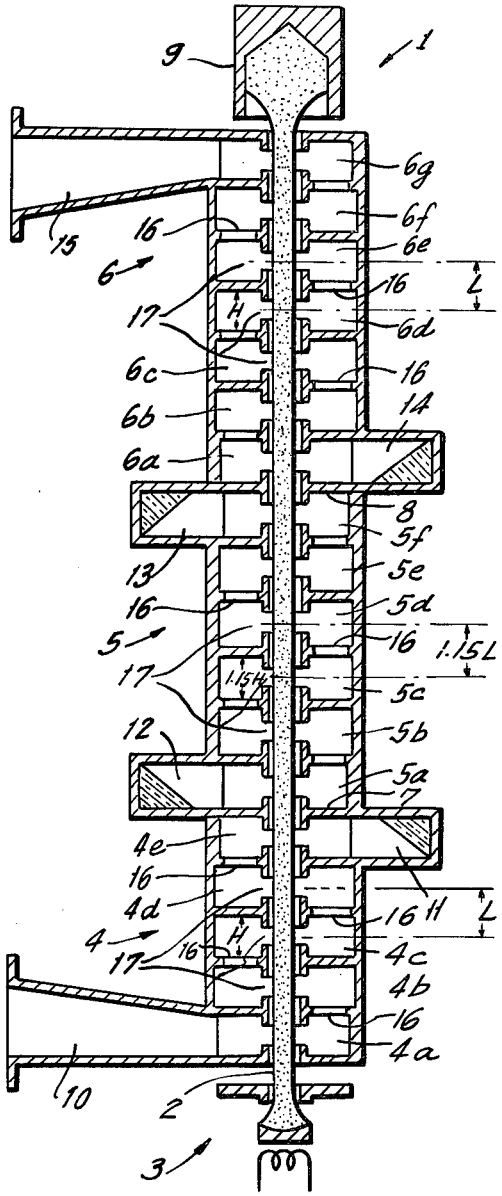
FIG. 4 is a longitudinal cross-section view showing the general construction of an essential part of a 3-section coupled-cavity type traveling-wave tube according to a second preferred embodiment of the present invention.

A second preferred embodiment of the 3-section coupled-cavity type traveling-wave tube according to the present invention is illustrated in longitudinal cross-section in FIG. 4.

An input slow-wave circuit 4 consists of a pair of coupler cavities 4*a* and 4*e* at the opposite ends of the slow-wave circuit and three main cavities 4*b*, 4*c* and 4*d* disposed therebetween, for a total of five unit cavities 4*a*, 4*b*, 4*c*, 4*d* and 4*e* which are electromagnetically coupled through coupling irises 16 provided in the partition walls between the adjacent cavities, to one end of the circuit is connected an input waveguide 10, and to the other end is connected a non-reflectively terminated waveguide 11. In the respective unit cavities 4*a*, 4*b*, 4*c*, 4*d* and 4*e*, the center to center distance between adjacent interaction gaps 17 is represented by L, while the height of the main cavities 4*b*, 4*c* and 4*d* is represented by H.

The intermediate slow-wave circuit 5 is constructed of a total of six unit cavities coupled to each other and consisting of a pair of coupler cavities 5*a* and 5*f* and four main cavities 5*b*, 5*c*, 5*d* and 5*e*, and to the opposite ends of the slow-wave circuit are connected non-reflectively terminated waveguides 12 and 13. In the respective unit cavities 5*a*, 5*b*, 5*c*, 5*d*, 5*e* and 5*f*, a center distance between adjacent interaction gaps 17 is selected equal to 1.5 L that is longer than that in the input slow-wave circuit 4, the height of the main cavities 5*b*, 5*c*, 5*d* and 5*e* is selected equal to 1.15 H that is larger than that in the input slow-wave circuit 4, and simultaneously, in order to make a $TM_{01}$ cavity mode pass-band of this slow-wave circuit equal to that of the input slow-wave circuit 4, the cavity diameter is selected to be smaller than that in the input slow-wave circuit 4.

An output slow-wave circuit 6 is constructed of a total of seven unit cavities coupled to each other and consisting of a pair of coupler cavities 6*a* and 6*g* and five main cavities 6*b*, 6*c*, 6*d*, 6*e* and 6*f*, to one end of the slow-wave circuit is connected a non-reflectively terminated waveguide 14, and to the other end is connected an output waveguide 15. In the respective unit cavities 6*a*, 6*b*, 6*c*, 6*d*, 6*e*, 6*f* and 6*g*, the center to center distance between adjacent interaction gaps 17 is selected to be equal to L similarly to the input slow-wave circuit 4, and the height of the main cavities 6*b*, 6*c*, 6*d*, 6*e* and 6*f* is also selected equal to H similarly to the input slow-wave circuit 4. In this way, by selecting the center to center distances between the adjacent interaction gaps equal in the input slow-wave circuit 4 and in the output slow-wave circuit 6, matching of the respective slow-wave circuits with the input wave guide 10 and the output waveguide 15, respectively, can be easily attained with common parts and a common adjusting method.

Figure 5:
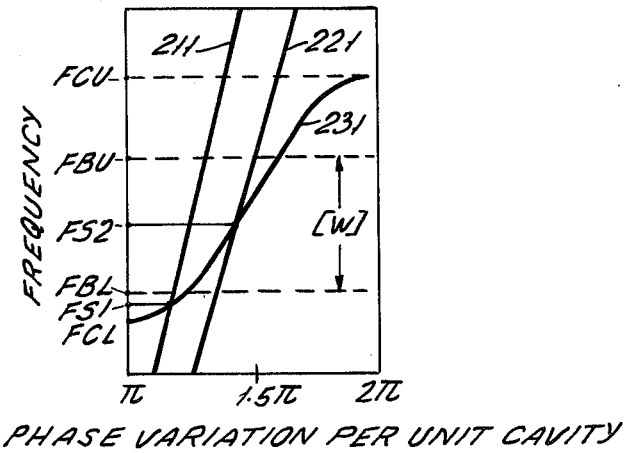
FIG. 5 is a graphical representation of the synchronizing relationship between traveling waves on the respective slow-wave circuits and the electron beam in the tube shown in FIG. 4 and an operating band width [W] of the tube.

Referring now to FIG. 5, the synchronizing relationship between the traveling-waves on the respective slow-wave circuits and the high frequency signal propagating through the electron beam in the form of density modulation and an operating band width [W] of the tube in the preferred embodiment illustrated in FIG. 4 are shown graphically, in which a straight line 211 represents phase versus frequency characteristics of the high frequency signals propagating in the electron beam in the input slow-wave circuit 4 and in the output slow wave circuit 6, a straight line 221 represents phase versus frequency characteristics of the high frequency signal propagating in the electron beam in the intermediate slow-wave circuit 5, and a curve 231 represents phase versus frequency characteristics of the traveling waves propagating on the respective slow-wave circuits.

From a cross point between the straight line 211 and the curve 231 is determined a synchronizing frequency FS1 of the input slow-wave circuit 4 and the output slow-wave circuit 6, and from a cross point between the straight line 221 and the curve 231 is determined a synchronizing frequency FS2 of the intermediate slow-wave circuit 5. The reason why the synchronizing frequency appears at two points as described above, is because in contrast to the fact that the phase change per one cavity of the traveling-waves on the respective slow-wave circuits has frequency characteristics as shown by the curve 231, the phase change per one cavity of the high frequency signal propagating in the electron becomes larger as the center distance between adjacent interaction gaps becomes longer, and consequently, as shown by the straight line 221 the phase change per one cavity of the high frequency signal propagating in the electron beam in the intermediate slow-wave circuit 5 has a larger rate of change for a given frequency than the straight line 211 in the case of the input slow-wave circuit 4 and the output slow-wave circuit 6.

Furthermore, upon extending the center distance between the adjacent interaction gaps 17 in the intermediate slow-wave circuit, in order to make the $TM_{01}$ cavity mode pass-bands equal to those of the other slow-wave circuits, the height of the unit cavities is selected to be larger and their diameter is selected to be smaller, so that the parallel impedance of each unit cavity is raised, and thereby an advantage can be obtained in that the coupling impedance of the slow-wave circuit is also raised.

Figure 6:
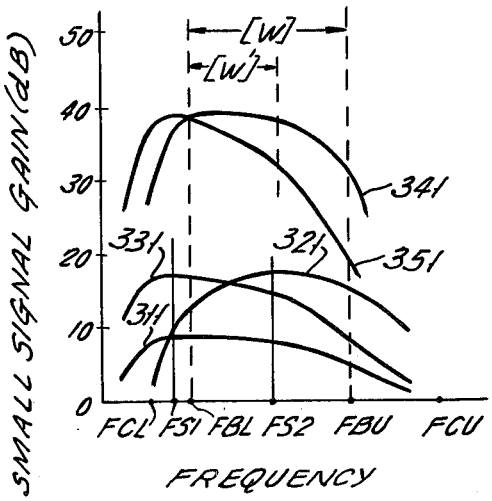
FIG. 6 is a graphical representation of small signal gain (dB) versus frequency characteristic curves of the tube shown in FIG. 4 and a tube according to the prior art design, and amplification characteristics of the respective slow-wave circuits, FIG. 7(*a*) is a longitudinal cross-section view showing the general construction of an essential part of a 3-section coupled-cavity type traveling-wave tube according to a third preferred embodiment of the present invention, FIG. 7(*b*) is a transverse cross-section view of the same traveling-wave tube taken along line A—A′ in FIG. 7(*a*), FIG. 7(*c*) is another transverse cross-section view of the same traveling-wave tube taken along line B—B′ in FIG. 7(*a*), FIG. 7(*d*) is still another transverse cross-section view of the same traveling-wave tube taken along line C—C′ in FIG. 7(*a*)

FIG. 6 shows the small signal gain versus frequency characteristics of the coupled-cavity type traveling-wave tube according to the present invention illustrated in FIG. 4 and a coupled-cavity type traveling-wave tube according to the prior art design as compared with each other. In this figure, curve 351 represents the characteristics of the tube according to the prior art design, while curve 341 represents the characteristics of the tube shown in FIG. 4. According to the prior art design, the synchronizing frequency is the same throughout the respective slow-wave circuits, and is selected at a frequency FS1 that is lower than an operating band lower edge frequency FBL, so that maximum gain is obtained at the frequency FS1 (Upon large signal operation, the point FBL appears at the lower limit point of the operating band that is 6 dB lower than the maximum gain point.), but at the higher frequencies the gain is lowered at a uniform rate, and thus the operating band width [W'] of the prior art tube was limited to 33% of the pass-band width of the output slow wave circuit. In contrast, according to the preferred embodiment of the present invention illustrated in FIG. 4, the sole amplification characteristics of the input slow-wave circuit 4 and the output slow-wave circuit 6 are represented by curves 311 and 331, respectively, whose maximum gain points being at FS1, but since the synchronizing frequency FS2 of the intermediate slow-wave circuit 5 is selected at a frequency lower than an operating band upper edge frequency FBU of the tube according to the prior art design, the amplification characteristics of the intermediate slow-wave circuit 5 are those represented by a curve 321, which just compensates for the degraded portions in the characteristics represented by the curves 311 and 331, and the coupling impedance of the intermediate slow-wave circuit 5 becomes high, so that it can be seen that the operating band width [W] of the tube 1 can be improved up to 53% of the pass-band width of the output slow-wave circuit 6 without lowering the gain.

While the slow-wave circuit was severed into three sections in the above-described embodiment, in the case where the slow-wave circuit is severed into still more sections, various modifications can be worked out by slightly changing the center distance between adjacent interaction gaps among two or more intermediate slow-wave circuits. In addition, for the purpose of extending the center to center distance between adjacent interaction gaps, a method of increasing the thickness the partition walls between adjacent unit cavities is known, and this method is advantageous for a high-power traveling wave tube in a millimeter band because thermal conduction can be enhanced.

Referring now to FIG. 7(*a*), a third preferred embodiment of the coupled-cavity type traveling-wave tube according to the present invention is shown in longitudinal cross-section, in which an input slow-wave circuit 4 consists of coupler cavities 4*a*, 4*a'*, 4*e* and 4*e'* disposed in pairs at the opposite ends of the slow-wave circuit and three main cavities 4*b*, 4*c* and 4*d* disposed therebetween, these seven unit cavities being electromagnetically coupled through coupling irises 16 provided in the partition walls between the adjacent cavities, to one end of the circuit is connected an input waveguide 10, and to the other end is connected a non-reflectively terminated wave-guide 11.

An intermediate slow-wave circuit 5 is constructed of a total of eight unit cavities coupled to each other, consisting of coupler cavities 5*a*, 5*a'*, 5*f* and 5*f'* disposed in pairs at the opposite ends of the slow-wave circuit and four main cavities 5*b*, 5*c*, 5*d* and 5*e*, and to the opposite ends of the slow-wave circuit are connected non-reflectively terminated waveguides 12 and 13. An output slow-wave circuit 6 is likewise constructed of a total of nine cavities coupled to each other, consisting of coupler cavities 6*a*, 6*a'*, 6*g* and 6*g'* disposed in pairs at the opposite ends of the slow-wave circuit and five main cavities 6*b*, 6*c*, 6*d*, 6*e* and 6*f*, to one end of the slow-wave circuit is connected a non-reflectively terminated waveguide 14, and to the other end is connected an output waveguide 15.

The height H of the main cavity, the outer radius $R_2$ and the inner radius $R_3$ of the drift tube, and the distance of the interaction gap 17 are, respectively, the same in the respective slow-wave circuits, and as shown in FIGS. 7(*b*), 7(*c*) and 7(*d*), an inner radius of the main cavities is selected equal to $R_1$ in the input slow-wave circuit 4 and in the output slow-wave circuit 6, whereas it is as small as 0.9 $R_1$ in the intermediate slow-wave circuit 5. In addition, in order to provide characteristic impedance matching between the waveguide and the main cavity section in the slow-wave circuit, only the inner diameter of the coupler cavities is selected to be smaller than that of the main cavities. On the other hand, aperture center radius $r_1$, aperture width $2r_2$ and aperture center angle $\theta$ of the coupling irises 16 between the main cavities are selected to be equal in the respective slow-wave circuits.

Figure 8:
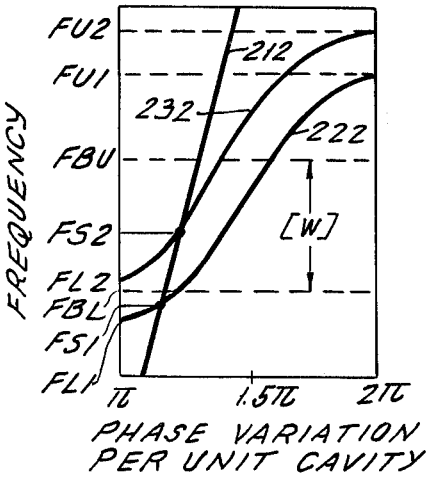
FIG. 8 is a graphical representation of the synchronizing relationship between traveling-waves on the respective slow-wave circuits and the electron beam in the tube shown in FIG. 7(*a*) and an operating band width [W] of the tube.

Referring TO FIG. 8, synchronizing relationship between the traveling-waves on the respective slow-wave circuits and the electron beam and an operating band width [W] of the tube in the preferred embodiment illustrated in FIG. 7(*a*) are shown graphically, in which a straight line 212 represents phase versus frequency characteristics of the high frequency signals propagating in the electron beam 2 at a D.C. beam velocity as density modulation, a curve 222 represents phase versus frequency characteristics of the traveling-waves propagating through the input slow-wave circuit 4 and the output slow-wave circuit 6 having the main cavities of larger inner diameter, and a curve 232 represents phase versus frequency characteristics of the traveling-wave propagating through the intermediate slow-wave circuit 5 having the main cavities of smaller inner diameter. From a cross point between the straight line 212 and the curve 222 is determined a synchronizing frequency FS1 of the input slow-wave circuit 4 and the output slow-wave circuit 6, and from a cross point between the straight line 212 and the curve 232 is determined a synchronizing frequency FS2 of the intermediate slow-wave circuit 5. The reason why the synchronizing frequency appears at two points as described above, is because both the $TM_{01}$ cavity mode higher cut-off frequency FU2 and the lower cut-off frequency FL2 of the intermediate slow-wave circuit 5 having the main cavities of smaller inner diameter, are higher than the $TM_{01}$ cavities mode higher cut-off frequency FU1 and the lower cut-off frequency FL1, respectively, of the input slow-wave circuit 4 and the output slow-wave circuit 6, due to the fact that the dimensions of the main cavities are the same throughout the respective slow-wave circuits except for the cavity inner diameter, and thus the phase velocity of the traveling-wave propagating through the intermediate slow-wave 5 is faster than the phase velocity through the input and output slow-wave circuits 4 and 6.

Figure 9:
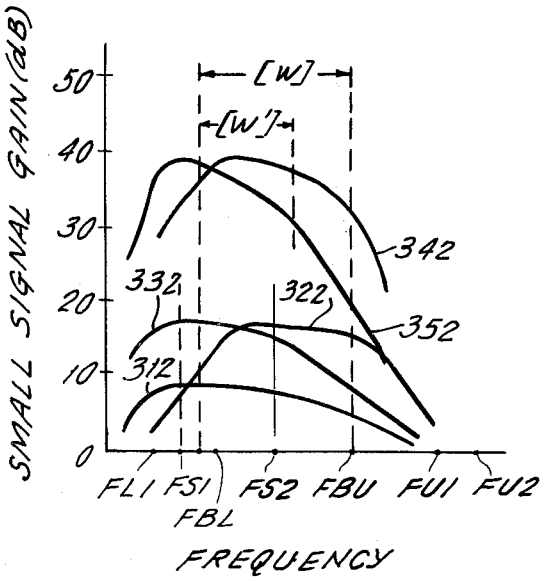
FIG. 9 is a graphical representation of small signal gain (dB) versus frequency characteristic curves of the tube shown in FIG. 7(*a*) and a tube according to the prior art design, and amplification characteristics of the respective slow-wave circuits.

FIG. 9 shows the small signal gain versus frequency characteristics of the coupled-cavity type traveling-wave tube according to the present invention illustrated in FIG. 7(*a*) and a coupled-cavity type traveling-wave tube according to the prior art design as compared with each other. In this figure, curve 352 represents the characteristics of the tube according to the prior art design, while curve 342 represents the characteristics of the tube shown in FIG. 7(*a*). According to the prior art design, the synchronizing frequency is the same throughout the respective slow-wave circuits, and is set at a frequency FS1 that is lower than a desired operating band lower edge frequency FBL, so that the maximum gain is obtained at the frequency FS1, but at the higher frequencies the gain is lowered at a uniform rate, and thus the operating band width [W'] of the prior art tube was limited to 33% of the pass-band width of the output slow-wave circuit. It is to be noted that though the point FBL on the curve 352 is located in the neighborhood of the maximum gain point in FIG. 9, this is due to the fact that the curve 352 represents the characteristics upon small signal operation, and upon large signal operation the point FBL appears at the lower limit point of the operating band width that is 6 dB lower than the maximum gain point. Whereas, according to the preferred embodiment of the present invention illustrated in FIG. 7(*a*), the sole amplification characteristics of the input slow-wave circuit 4 and the output slow-wave circuit 6 are represented by curves 312 and 332, respectively, whose maximum gain point is at FS1, but since the synchronizing frequency FS2 of the intermediate slow-wave circuit 5 is selected at a frequency lower than an operating band upper edge frequency FBU of the tube according to the prior art design, the amplification characteristics of the intermediate slow-wave circuit 5 are those represented by a curve 322, which just compensates for the degraded portions in the characteristics represented by the curves 312 and 332, and the coupling impedance of the intermediate slow-wave circuit 5 becomes high, so that it can be seen that the operating band width [W] of the tube 1 can be improved up to 53% of the passband width of the output slow-wave circuit 6 without lowering the gain.

Furthermore, since the pass-band widths of the input slow-wave circuit 4 and the output slow-wave circuit 6 contain the operating band width [W] of the tube 1 therein, they can be easily matched with external circuits via the input waveguide 10 and the output waveguide 15, respectively.

Figure 10:
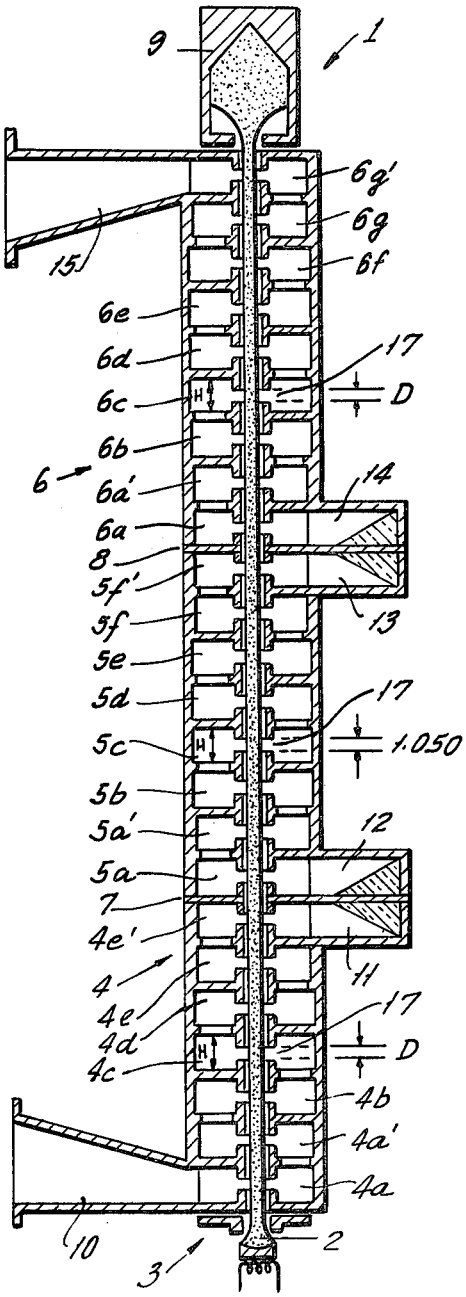
FIG. 10 is a longitudinal cross-section view showing a general construction of an essential part of a 3-section coupled-cavity type traveling-wave tube according to a fourth preferred embodiment of the present invention.

With reference to FIG. 10, a fourth preferred embodiment of the coupled-cavity type traveling-wave tube according to the present invention is shown in longitudinal cross-section. The illustrated traveling-wave tube has substantially the same construction as that shown in FIG. 7(*a*), except that the dimension of the interaction gaps 17 in the main cavities of the intermediate slow-wave circuit 5 is 1.05 times as large as the interaction gaps 17 in the main cavities of the other slow-wave circuits 4 and 6 with the other dimensions of the main cavities in the intermediate slow-wave circuit 5 all kept equal to those in the remaining slow-wave circuits.

Since the $TM_{01}$ cavity mode higher cut-off frequency and the coupling impedance of the coupled-cavity type slow-wave circuit are determined by the dimensions of the main cavities in the slow-wave circuit, in the case where the heights of the main cavities in the respective slow-wave circuits are the same as those of the third and fourth preferred embodiments, in the preliminary slow-wave circuit having an inner diameter of main cavities reduced and/or having an interaction gap dimension enlarged with respect to an output slow-wave circuit, yields the effects that the $TM_{01}$ cavity mode upper cut-off frequency can be raised and the coupling impedance can be also increased. Consequently, the synchronizing frequency of the preliminary slow-wave circuit in which the $TM_{01}$ cavity mode upper cut-off frequency has been raised, can be placed within an operating band, so that by selecting this synchronizing frequency in the proximity of the upper edge frequency of the operating band according to the prior art, a broad operating band width exceeding 50% of the $TM_{01}$ cavity mode pass-band width of the output slow-wave circuit can be realized without lowering the gain and the efficiency of the tube.

While only in one of two preliminary slow-wave circuits either the inner diameter of main cavities was reduced or the interaction gap distance was enlarged according to the third and fourth embodiments described above, according to the present invention both provisions can be employed, and various other modifications can be made such as reducing the inner diameter of main cavities and/or enlarging the interaction gap distance in two or more slow-wave circuits.

Since many changes and modifications can be made in the above embodiments and many other embodiments can be made without departing from the spirit of the present invention, the foregoing description and accompanying drawings should be interpreted as illustrative and not in a limiting sense.

What is claimed is:

1. A wide-band coupled-cavity type traveling-wave tube adapted to amplify a high frequency signal, said traveling wave tube comprising:

(A) means defining a long beam path;

(B) electron gun means for generating an electron beam and for directing said beam along said beam path;

(C) a collector electrode located at a terminal end of said long beam path;

(D) a plurality of preliminary slow-wave circuits and an output slow-wave circuit disposed along said beam path, each of said slow-wave circuits including:

(1) first and second coupler cavities located at opposite ends of said slow-wave circuit;

(2) at least two main cavities located between said coupler cavities;

(3) coupling irises located in partition walls between adjacent said main cavities; and (4) interaction gaps permitting said electron beam to interact with traveling waves in said slow-wave circuit;

(E) circuit sever sections having non-reflective terminals and disposed between adjacent ones of said slow-wave circuits;

(F) each of said main cavities having the same height and inner diameters;

(G) each of said interaction gaps having the same dimensions;

(H) each of said irises in all but one of said preliminary slow-wave circuits and each of said irises in said output slow-wave circuit having the same first predetermined size and shape; and (I) each of said irises in said one of said preliminary slow-wave circuits having the same second predetermined size and shape which is smaller than said first predetermined size and shape whereby said one of said preliminary slow-wave circuits exhibits a lower band pass than the remaining of said slow-wave circuits.

2. A wide-band coupled-cavity type traveling-wave tube as claimed in claim 1, wherein said plurality of preliminary slow-wave circuits consist of one input slow-wave circuit and one intermediate slow-wave circuit, said intermediate slow-wave circuit defining said one of said preliminary slow-wave circuits.

3. A wide-band coupled-cavity type traveling-wave tube as claimed in claim 2, wherein:

said input slow-wave circuit comprises a coupler cavity at each end of the slow-wave circuit and three main cavities;

said intermediate slow-wave circuit comprises a coupler cavity at each end of the slow-wave circuit and four main cavities; and said output slow-wave circuit comprises a coupler cavity at each end of the slow-wave circuit and five main cavities therebetween.

4. A wide-band coupled-cavity type traveling-wave tube as claimed in claim 3, wherein the inner diameter of each of said coupler cavities is smaller than the inner diameter of each of said main cavities.

5. A wide-band coupled-cavity type traveling-wave tube as claimed in claim 4, wherein the iris center angle of said intermediate slow-wave circuit is smaller than that of said input slow-wave circuit.

6. A wide-band coupled-cavity type traveling-wave tube as claimed in claim 5, wherein the center angle of said irises of said intermediate slow-wave circuit is equal to 64 degrees, and the center angle of said irises of said input slow-wave circuit and said output slow-wave circuit is equal to 70 degrees.

7. A wide-band coupled-cavity type traveling-wave tube adapted to amplify a high frequency signal, said traveling-wave tube comprising:

(A) drift tube means defining a long beam path;

(B) electron gun means for generating an electron beam and for directing said beam along said path;

(C) a collector electrode located at a terminal end of said long beam path;

(D) a plurality of preliminary slow-wave circuits and an output slow-wave circuit disposed along said beam path, each of said slow-wave circuits including:

(1) first and second coupler-cavities located at opposite ends of said slow-wave circuit;

(2) at least two main cavities located between said coupler-cavities;

(3) coupling irises located in partition walls between adjacent said main cavities; and (4) interaction gaps permitting said electron beam to interact with traveling-waves in said slow-wave circuit;

(E) circuit sever sections having non-reflective terminals and disposed between adjacent ones of said slow-wave circuits; ;p1 (F) each of said main cavities having the same height;

(G) each of said interaction gaps having the same dimensions;

(H) each of said irises having the same dimensions;

(I) the inner diameter of said main cavities of all but one of said preliminary slow-wave circuits and the inner diameter of said main cavities of said output slow-wave circuit being a first diameter D1; and (J) the inner diameter of said main cavities of said one of said preliminary slow-wave circuits being equal to a second diameter $D2 < D1$ wherein said one of said preliminary slow-wave circuits exhibits a lower band pass than the band pass of the remaining of said slow-wave circuits.

8. A wide-band coupled-cavity type traveling-wave tube as claimed in claim 7, wherein said preliminary slow-wave circuits comprise one input slow-wave circuit and one intermediate slow-wave circuit, said one intermediate slow-wave circuit defining said one of said preliminary slow-wave circuits, and the inner diameters of the main cavities in the intermediate slow-wave circuit are approximately 0.9 times as large as the inner diameters of the main cavities in the other slow-wave circuits.

9. A wide-band coupled-cavity type traveling-wave tube adapted to amplify a high frequency signal, said traveling-wave tube comprising:

(A) drift tube means defining a long beam path;

(B) electron gun means for generating an electron beam and for directing said beam along said beam path;

(C) a collector electrode located at a terminal end of said long beam path;

(D) a plurality of preliminary slow-wave circuits and an output slow-wave circuit disposed along said beam path, each of said slow-wave circuits including:

(1) first and second coupler-cavities located at opposite ends of said slow-wave circuit;

(2) at least two main cavities located between said coupler-cavities;

(3) coupling irises located in partition walls between adjacent said main cavities; and (4) interaction gaps permitting said electron beam to interact with traveling-waves in said slow-wave circuit;

(E) circuit sever sections having non-reflective terminals and disposed between adjacent ones of said slow-wave circuits;

(F) the inner diameter of said main cavities of at least one of said preliminary slow-wave circuits being smaller than the inner diameter of said main cavities of both the remaining said preliminary slow-wave circuits and output slow-wave circuit; and (G) the dimensions of said interaction gaps in said main cavities in said at least one of said preliminary slow-wave circuits being larger than the dimension of said interaction gaps in said main cavities of both the remaining said slow-wave circuits and said output slow-wave circuit whereby said one of said preliminary slow-wave circuits exhibits a lower band pass than the band pass of the remaining of said slow-wave circuits.

* * * * *